United States Patent [19]

Walters et al.

[11] 4,083,447

[45] Apr. 11, 1978

[54] CARTONS WITH CRADLE FORMING END CLOSURES

[75] Inventors: Chester F. Walters, Middletown; Robert M. Bergstein, Cincinnati, both of Ohio

[73] Assignee: Bergstein Packaging Trust, Middletown, Ohio

[21] Appl. No.: 709,003

[22] Filed: Jul. 26, 1976

[51] Int. Cl.[2] ..... B65D 5/50

[52] U.S. Cl. ..... 206/45.19; 206/45.34; 206/815; 206/476; 229/41 B; 229/5.5; 229/DIG. 3

[58] Field of Search ..... 206/45.19, 45.23, 45.22, 206/45.25, 476, 45.14, 815, 45.34; 229/DIG. 3, 41 R, 41 B, 57, 58, 5.5; 312/259

[56] References Cited

U.S. PATENT DOCUMENTS

| | | | |
|---|---|---|---|
| 2,326,648 | 8/1943 | Horr | 229/41 B |
| 2,931,493 | 4/1960 | Pfohl | 206/45.34 |
| 2,984,401 | 5/1961 | Herkender | 229/41 B |
| 3,010,571 | 11/1961 | Transport | 206/45.15 |
| 3,366,227 | 1/1968 | Strazza | 206/45.19 |

FOREIGN PATENT DOCUMENTS

| | | | |
|---|---|---|---|
| 757,927 | 5/1967 | Canada | 206/45.14 |
| 1,192,250 | 5/1970 | United Kingdom | 206/45.14 |

*Primary Examiner*—William Price
*Assistant Examiner*—Joseph M. Moy
*Attorney, Agent, or Firm*—Melville, Strasser, Foster & Hoffman

[57] ABSTRACT

A knock-down display carton having a tubular body formed from opposing body panels hingedly connected together along their opposite side edges, the carton being formed from a flat-folded blank which may be composed entirely of paperboard or a composite blank having a paperboard body panel and an opposing flexible plastic body panel, the structure having at least a bottom end closure hingedly connected to one end of the paperboard panel, said end closure comprising a flap member adapted to be initially juxtaposed to the inner surface of the body panel to which it is hingedly connected, the flap member being scored to define inner and outer flap parts, the outer flap part being displaceable inwardly to provide a self-sustaining cradle-like support for an article packaged in the carton.

13 Claims, 14 Drawing Figures

CARTONS WITH CRADLE FORMING END CLOSURES

BACKGROUND OF THE INVENTION

The present invention relates basically to paperboard cartons, and more particularly to a display carton a portion of which is formed from a transparent material or cut-away so that the contents of the carton may be readily viewed by a prospective purchaser. While the invention will find utility in the packaging of diverse consumer items, it is particularly suited for the packaging of liquid containing bottles, the carton having at least its bottom closure formed to provide a cradle which will support the weight of the bottle and its contents as well as cushion the bottle against shock.

Cartons having a body of the type contemplated by the present invention have been previously proposed wherein the body is composed of an opposing pair of body wall panels hingedly connected together along their opposite side edges, the body walls being flexed or bowed in opposite directions to form a tubular body for surrounding the contents. Hereintofore, the end closures for such cartons have comprised single flap members hingedly connected to one of the body panels, the flap members being configured to conform to the desired cross-sectional dimensions of the erected body. Such single flap end closures, while effectively closing the opposite ends of the carton body, are not capable of sustaining any appreciable weight load, and consequently the cartons are limited to the packaging of relatively lightweight contents. In addition, the ends of the carton body walls and the end closure flaps are usually of bowed or curved configuration so that the cartons cannot stand on their end edges, and consequently they must be displayed lying on their sides in which position there is little or no force exerted on the end closures by the contents.

It also has been proposed to provide tubular or sleeve-like container bodies with separate end closures, such as plastic end caps, which enter into tight engagement with the opposite ends of the container body. While such end caps are highly satisfactory for many purposes, they nonetheless require separate handling during the assembly of the containers and add to the over-all cost of the containers.

In contrast to the foregoing, the present invention provides a simple, inexpensive and yet highly effective end closure which is integrally formed with the carton body and, when erected, provides an extremely strong end closure which is capable of sustaining the weight of a filled bottle or other relatively heavy article packaged in the carton, the construction being such that the carton may be stood on end to effectively display its contents in upright position.

SUMMARY OF THE INVENTION

In accordance with the invention, the carton body is formed from a paperboard blank which defines at least one of an opposing pair of body panels, together with at least one attachment flap for hingedly connecting the adjoining side edges of the opposing body panels to each other to form a tubular body. A cradle forming end closure in accordance with the invention will be hingedly connected to at least the bottom end edge of the paperboard panel. In the event the second body panel is also formed from paperboard, it will be connected to the opposite side edge of the first body panel along a common score line and preferably will be provided with a window forming opening through which the contents of the carton may be viewed. Depending upon the nature of the contents, the window opening may remain uncovered, as where the opening is positioned to display the label on a liquor bottle or the like, or it may be covered with a sheet of transparent film. In another version of the invention, the second body panel may comprise a sheet of self-sustaining plastic material, in which event the paperboard body panel will have a pair of attachment flaps hingedly connected to its opposite side edges so that the opposite side edges of the plastic panel may be secured thereto, thereby forming a tubular carton body.

The cradle forming end closure, which normally will be used as the bottom end closure for the tubular body, comprises a flap member hingedly connected to the lowermost end of the first body panel, the flap member preferably having a width equal to the width of the body panel. The flap, which is generally rectangular, is provided with a curved or arcuate score line extending inwardly from its outermost end edges, the curved score line defining a cradle forming flap part which bows downwardly and inwardly within the carton body when in the erected position.

In the formation of the cradle forming end closure, the flap member is initially infolded and juxtaposed to the inner surface of the body panel to which it is hingedly connected as an incident of the formation of the flat-folded carton structure. When the carton body is erected, i.e., the opposing body walls bowed outwardly by applying inwardly directed pressure against their opposite side edges, the cradle forming flap part may then be deflected downwardly so that it extends crosswise between the opposing body panels. In order to facilitate the downward displacement of the cradle forming flap part, a finger opening is provided in the body panel to which the flap is juxtaposed, the finger opening being aligned with the cradle forming flap part so that the flap part may be displaced to its erected condition by inserting a finger or other probe through the opening.

If desired, a cradle forming end closure may be used at the opposite or upper end of the carton, although other forms of end closures may be employed, inclusive of a conventional single flap end closure as previously described in connection with the prior art. Alternatively, other flap arrangements may be employed, as where it is desired to have the top end closure engage about the neck of a bottle. It also may be desirable to configure the body panel which forms the front of the carton to expose additional portions of the bottle neck, as where there is a label or other indicia on the neck which it is desired to expose to view.

DESCRIPTION OF THE PREFERRED EMBODIMENTS

Figure 1:
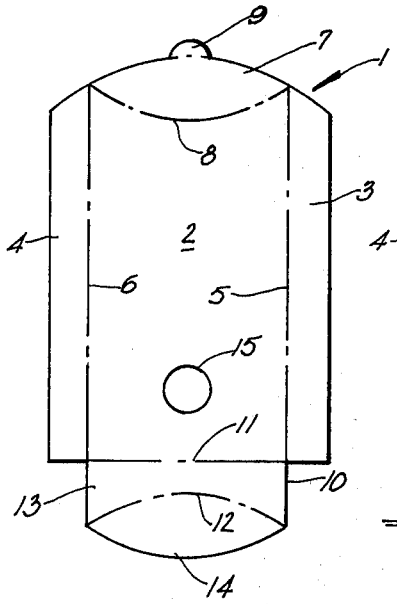
FIG. 1 is a blank for forming a two-piece carton incorporating a cardle forming end closure in accordance with the invention.

Reference is first made to FIG. 1 of the drawings which illustrates a paperboard blank, indicated generally at 1, for forming one embodiment of a carton in accordance with the invention. The blank comprises a body forming panel 2 having attachment flaps 3 and 4 hingedly connected to its opposite side edges along score lines 5 and 6, respectively. At its uppermost end, the body panel 2 is provided with a closure flap 7 hingedly connected to body panel 2 along the curved score line 8, the configuration of the closure flap 6 corresponding to the cross-sectional dimensions of the erected carton body. In the embodiment illustrated, a pull tab 9 is hingedly connected to the outermost side edge of the closure flap to facilitate movement of the closure flap from closed to open position.

Figure 2:
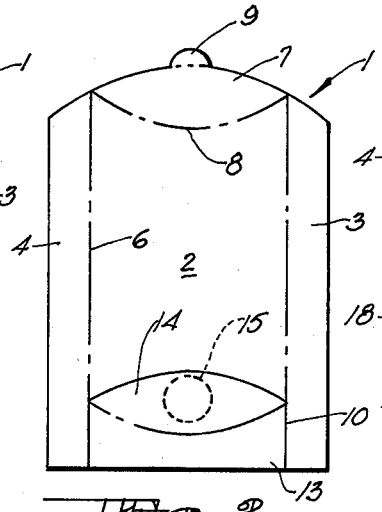
FIG. 2 is a plan view of the blank shown in FIG. 1 with the bottom closure in initially infolded condition.

In accordance with the invention, a flap member 10 is hingedly connected to the bottom edge of body panel 2 along score line 11, the flap member being divided by the curved score line 12 into an inner part 13 and an outer cradle forming flap part 14 having, in this instance, a configuration corresponding to that of closure flap 7. The body panel 2 is provided with a finger opening 15 positioned to coincide with cradle forming flap part 14 when the flap member 10 is infolded to the position illustrated in FIG. 2, which comprises the first step in the fabrication of the blank into a knocked-down, flat-folded carton structure.

Figure 3:
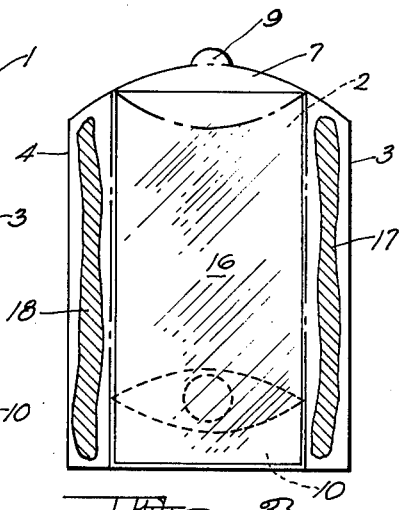
FIG. 3 is a plan view similar to FIG. 2 illustrating the juxtaposition of a transparent sheet on the blank to form the opposing body panel.

Referring next to FIG. 3, upon the infolding of the flap member 10, a rectangular sheet of transparent plastic material 16 is deposited on paperboard body panel 2, the sheet of plastic material being of substantially the same size as body panel 2, thereby providing an opposing body panel defining the opposite half of the carton body being formed. The material from which the plastic panel is formed does not constitute a limitation on the invention; it should, however, be self-sustaining and yet sufficiently flexible to permit the panel to be bowed into curved or arcuate configuration as an incident of the erection of the tubular body. Plastic sheets of vinyl or acetate having a thickness of about 7 mils have been found to be particularly suited for the purpose, and it has also been found desirable to cut the plastic with its grain orientation extending lengthwise of the carton body to achieve smooth and uniform flexing of the sheet. As used herein, the term "self-sustaining" is intended to denote a condition in which the plastic panel is flexible yet sufficiently rigid to maintain its shape, as opposed to a thin film of sheet material which is limp and lacking in sufficient body to maintain its shape.

Figure 4:
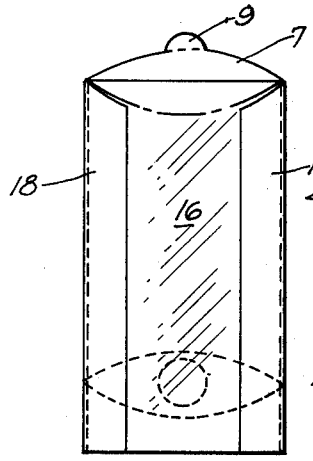
FIG. 4 is a plan view illustrating the knocked-down flat-folded carton blank.

The carton is completed by applying stripes of adhesive 17 and 18 to the attachment flaps 3 and 4, respectively, whereupon the attachment flaps are infolded and adhesively secured to the marginal side edges of the plastic panel 16, the carton thereby assuming the knocked-down condition illustrated in FIG. 4, in which condition the cartons may be stored and shipped to the user.

Figure 5:
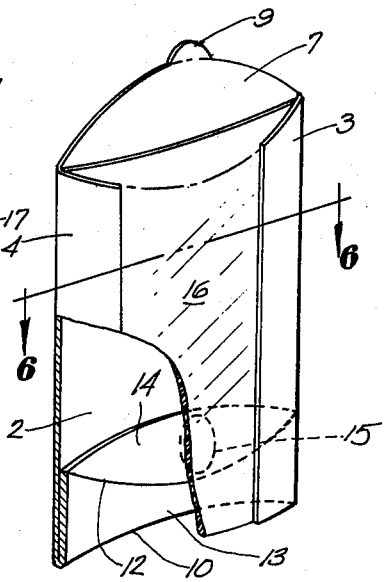
FIG. 5 is a perspective view with parts broken away illustrating the carton blank in the erected condition prior to the infolding of the end closures.
Figure 6:
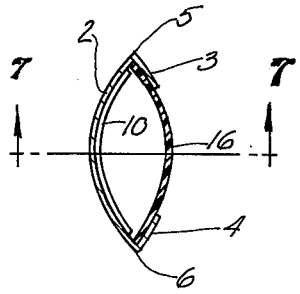
FIG. 6 is a horizontal sectional view taken along the line 6—6 of FIG. 5.
Figure 9:
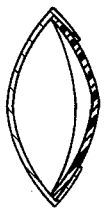
FIG. 9 is a horizontal sectional view of the erected end closure taken along the line 9—9 of FIG. 8.

When it is desired to use the carton, the carton body may be readily erected by pressing inwardly along the opposite side edges of the flat blanks, i.e., along the score lines 5 and 6, thereby bowing the opposing body panels 2 and 16 outwardly, the carton assuming the erected condition illustrated in FIG. 5. It will be noted that body panels 2 and 16 are bowed outwardly in opposite directions, and that both top closure flap 7 and infolded flap member 10 also will be bowed, following the configuration of the body panel 2 to which they are attached. The cross-sectional configuration of the carton body is seen in FIG. 6 and, in this instance, may be characterized as eliptical-lanceolate. It may be noted by comparing FIGS. 1 and 6 that the shapes of both the top closure flap 7 and cradle forming flap part 14 correspond to the cross-section of the erected carton body so that, when infolded, the claps will effectively close the ends of the carton body.

Figure 7:
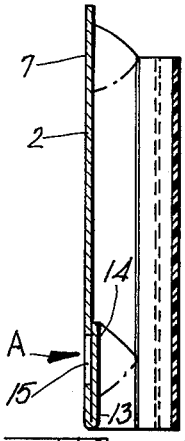
FIG. 7 is a vertical sectional view taken along the line 7—7 of FIG. 6.
Figure 8:
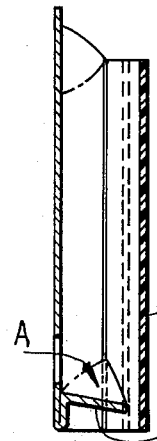
FIG. 8 is a vertical sectional view similar to FIG. 7 but with the cradle forming flap part in the fully erected condition.
Figure 10:
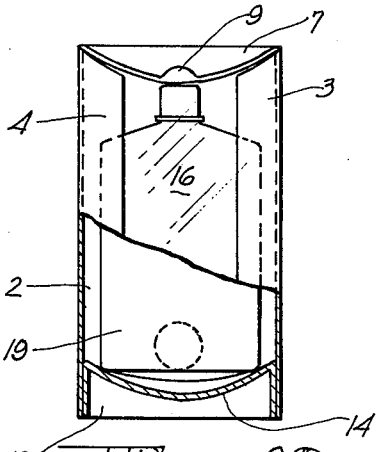
FIG. 10 is a front elevational view with parts broken away showing the erected and closed carton containing a bottle.

The cradle forming bottom closure is erected in the manner illustrated in FIGS. 7 and 8, by inserting a finger or other probe, indicated by the Arrow A, through the finger opening 15 in body panel 2, thereby deflecting the cradle forming flap part 14 downwardly, the cradle forming flap part folding along the curved score line 12 by means of which it is hingedly connected to the inner part 13 of flap member 10. When so folded, the cradle forming flap part will assume a bowed configuration and will project forwardly toward the body panel 16. Due to the curved configuration of score line 12, as well as the bowed configuration of the inner flap part 13, the cradle forming flap 14 will be effectively retained in a position in which it projects more or less horizontally across the carton body and hence serves to support the weight of a bottle or other contents inserted in the carton body. Thus, as seen in FIG. 10, a relatively flat bottle 19 is shown packaged in the carton, and it will be readily apparent that the bottom end of the bottle is supported on and cushioned by the flap part 14 which is spaced upwardly from the lowermost edges of the body panels 2 and 4.

It may be noted that the inner part 13 of flap member 10 need not be adhesively secured to the portion of body panel 2 to which it is juxtaposed; rather, the configuration of the parts is such that the inner part 13 will remain in tight contact with the body panel 2 without the necessity for adhesive attachment. Of course, the inner part 13 may be adhesively secured to the inner surface of body panel 2 for greater security, athough such additional adhesive attachment is unnecessary for most purposes. As seen in FIG. 10, when the top closure flap 7 is infolded, the pull tab 9 will be juxtaposed to the inner surface of body panel 16, the tab projecting upwardly from the infolded closure flap, thereby enabling the user to readily engage the tab to open the top closure flap.

Figure 11:
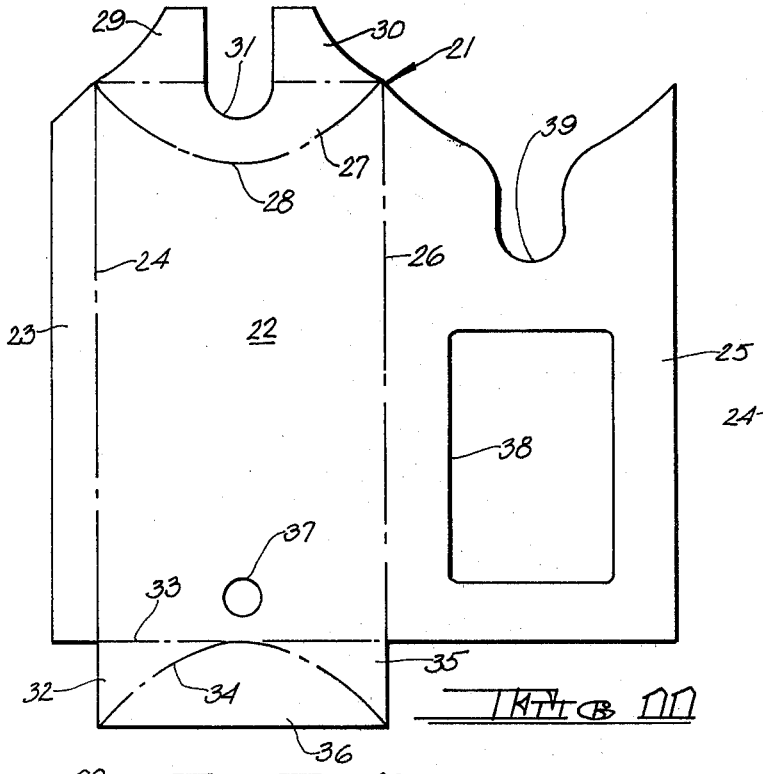
FIG. 11 is a plan view of a blank for forming a modified carton structure from an integral paperboard blank having a window opening in the front body panel and a neck engaging top closure.

Referring next to FIG. 11 which illustrates a modification in which the carton is formed from a paperboard blank which defines both the front and rear body panels, and in which the neck and cap of the packaged bottle are exposed. In this embodiment, the carton blank, indicated generally at 21, has a body forming panel 22 and a single attachment flap 23 hingedly connected to the free side edge of body panel 22 along the score line 24. A second body panel 25 is hingedly connected to the opposite side edge of body panel 22 along score line 26. A top closure flap 27 is formed at the upper end of body panel 22 and separated therefrom by curved score line 28. In this embodiment, the top closure includes a pair of tuck flaps 29 and 30 lying to opposite sides of an arcuate cut-out 31 in top closure flap 27.

In accordance with the invention, a rectangular flap member 32 is hingedly connected to the lowermost end of body panel 22 along score line 33, and a curved score line 34 divides the rectangular flap into an inner part 35 and an outer cradle forming flap part 36. In this embodiment, the innermost extent of the cradle forming flap part 36 coincides with the score line 33 defining the lowermost end edge of body panel 22. A finger opening 37 is cut from body panel 22 and positioned to coincide with cradle forming flap part 36 when the rectangular flap 32 is infolded and juxtaposed to the inner surface of body panel 22. The opposing body panel 25 is provided with a window opening 38 and the upper edge of panel 25 is also cut-away to define a recessed central portion 39 which, as will become evident hereinafter, exposes the neck of a bottle packaged in the carton.

The window opening 38 may or may not be covered with a film of transparent window forming material. In the case of a liquor bottle or the like, the label of the bottle may be directly exposed through the window opening, although if the window opening is to be converted, a sheet of transparent material 40 may be adhesively secured to the inner surface of body panel 25. The sheet material 40 may comprise the same plastic material used for previously described body panel 16, although it is preferred to use a thin film of transparent sheet material which is less expensive. Such thin film need not be self-sustaining in that it is adhered to and supported by the paperboard panel which surrounds it.

Figure 12:
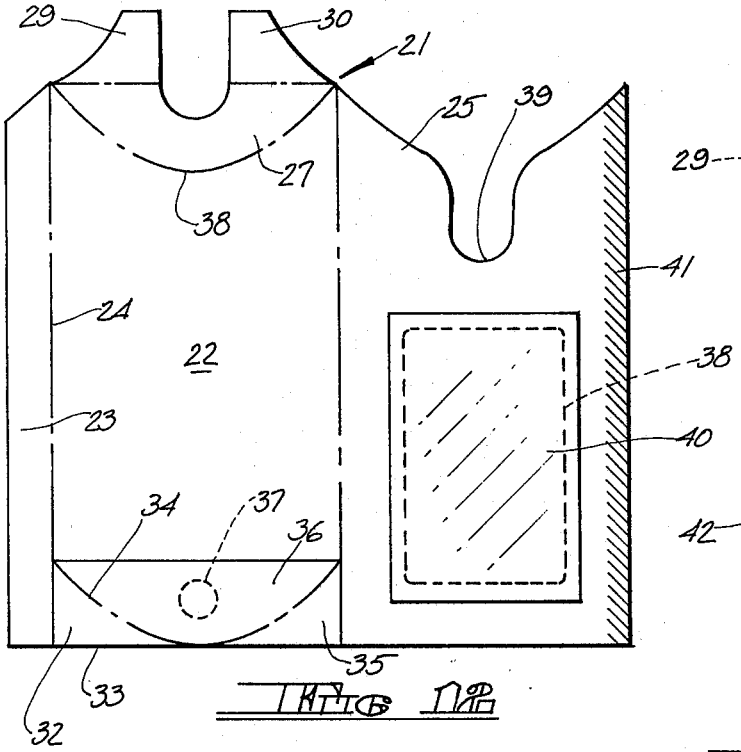
FIG. 12 is a plan view illustrating the blank of FIG. 11 with the bottom closure infolded and a transparent film covering the window opening.

Following the application of the transparent window material, if it is used, and the infolding of the rectangular flap 32 to the condition illustrated in FIG. 12, the carton will be tubed by adhesively securing the attachment flap 23 to the free side edge of body panel 25. Preferably, the attachment flap 23 will lie to the inside of the tubed body, and to this end an adhesive stripe 41 may be conveniently applied to the outer marginal side edge body panel 25, and the attachment flap 23 will be infolded to overlie body panel 22 prior to the infolding of body panel 25 along score line 26, to juxtapose the adhesive stripe 41 to the upper surface of the infolded atachment flap 23, the tubed carton thus assuming the knocked-down, flat-folded condition illustrated in FIG. 13.

As in the case of the preceding embodiment, the carton body will be erected by pressing inwardly on the opposite side edges of the body wall panels 22 and 25, followed by the erection of the cradle forming flap part 36 in the manner previously described, the user inserting a finger or probe through the finger opening 37 to deflect the cradle forming flap part 36 to its laterally extending position. In this instance the cradle forming flap part does not completely close the lowermost end of the carton body due to the fact that flap part 36 has a straight side edge, being formed from a part of rectangular flap member 32. Nonetheless, the cradle provides a firm yet resilient support for the packaged article and less paperboard is required for the end closure. In this embodiment the central portion of the cradle forming flap part 36, when erected, coincides with the lowermost edges of the front and rear body panels and hence seats on the supporting surface on which the carton is placed, but the bottle itself is elevated relative to the supporting surface by the bowed configuration of the flap part and hence is cushioned against shock. Obviously, in this arrangement wherein the maximum width of the cradle flap part 36 is equal to the width of rectangular flap member 32, less box board is required than in the preceding embodiment. The inner part 35 of the bottom closure need not be adhesively secured to the body panel 22, athough such attachment is preferred if a relatively large and heavy object is being packaged.

Figure 13:
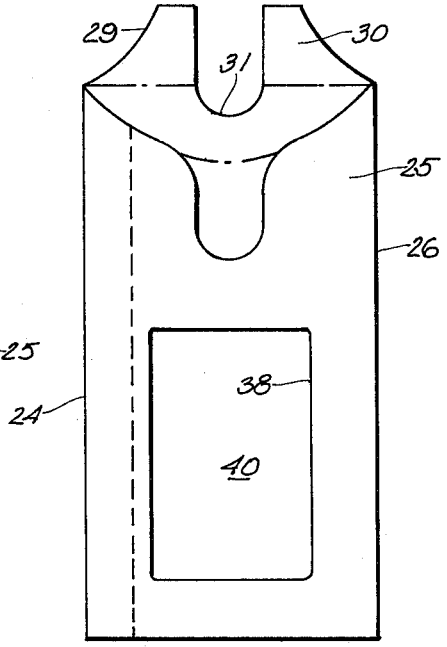
FIG. 13 is a plan view illustrating the modified blank in the knocked-down flat-folded condition.
Figure 14:
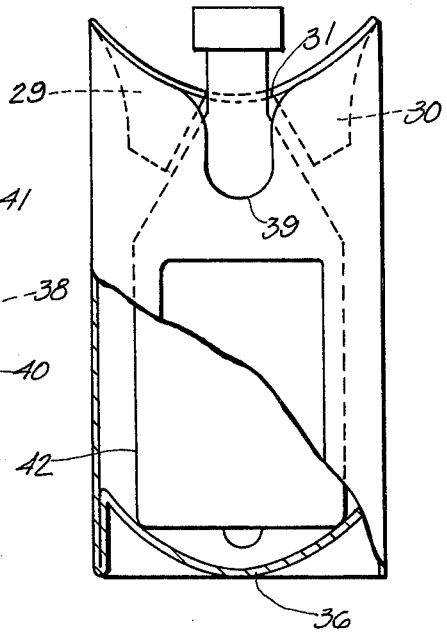
FIG. 14 is a front elevational view with parts broken away illustrating the modified blank in erected condition containing a bottle.

Upon erection of the bottom closure a bottle, such as the bottle 42 seen in FIG. 13, may be inserted into the carton from its top end, followed by the infolding of top closure flap 27 and tuck flaps 29 and 30, the latter tuck flaps being juxtaposed to the inner surface of front wall panel 25 in a manner which will be apparent in FIG. 14. In this embodiment the arcuate cut-out 31 in top closure flap 27 engages about the projecting neck of the bottle which extends freely above the top closure flap 27. The recessed central portion 39 of front body panel 24 serves to expose the neck of the bottle and any printed indicia, such as a neck label, which may be carried by the bottle.

As should now be evident, the present invention provides an inexpensive and easy to manufacture tubular carton initially formed in knocked-down flat-folded condition, together with a unique bottom closure which is readily capable of sustaining the weight of the packaged article even though it comprises a relatively heavy bottle, and at the same time the bottom closure provides a cushion for the packaged article. The bottom closure requires a minimum amount of additional paperboard and it is easy to assemble both in the initial formation of the flat-folded carton and in its subsequent displacement to the erected position. In addition to providing for the display of the packaged commodity, numerous decorative effects can be achieved.

Modifications can be made in the invention without departing from its spirit and purpose. A number of such modifications have already been suggested, and others will undoubtedly occur to the worker in the art upon reading this specification. Accordingly, the embodiments illustrated are intended to be representative only, the essential feature of the invention being the provision of a cradle forming bottom closure which, if desired, also may be used as a top closure, although other and different top closure arrangements may be employed.

The embodiment of the invention in which an exclusive property or privilege is claimed are defined as follows:

1. In a knock-down carton having opposing body forming panels hingedly connected together along their opposite side edges to define a flat-folded tubular body adapted to be erected by flexing said body forming panels outwardly relative to each other, a cradle forming end closure for said tubular body, said end closure comprising a flap member hingedly connected to an end edge of one of said body panels, said flap member being divided by a curved score line into an inner part and a cradle forming outer flap part, said flap member lying in infolded condition with both said inner and outer flap parts initially justaposed to the inner surface of the body wall panel to which said flap member is connected, said outer flap part being displaceable inwardly along said curved score line to at least partially close the end of the carton body and provide a self-sustaining cradle-like supporting seat for the contents of the carton, a finger opening formed in the body panel to which said flap member is hingedly connected, said finger opening being positioned to coincide with said cradle forming outer flap part when said outer flap part is juxtaposed to the inner surface of the body panel to which said flap member is hingedly connected.

2. The structure claimed in claim 1 wherein the configuration of said cradle forming outer flap part corresponds to the cross-sectional configuration of said erected carton body.

3. The structure claimed in claim 1 wherein said flap member is of rectangular configuration, and wherein said cradle forming outer flap part has a maximum front to rear dimension which is less than the maximum front to rear dimension of the erected carton body.

4. The structure claimed in claim 3 wherein said cradle forming flap part has a straight-line free edge.

5. The structure claimed in claim 1 wherein the curved score line in said flap member lies in spaced relation to the end edge of the body panel to which said flap member is hingedly connected.

6. The structure claimed in claim 1 wherein said curved score line makes tangential contact with the end edge of the body panel to which said flap member is hingedly connected.

7. The structure claimed in claim 1 wherein the body panel opposite the body panel to which said flap member is hingedly connected comprises a sheet of self-sustaining flexible plastic material.

8. The structure claimed in claim 1 wherein both of said body panels are formed from paperboard, and wherein one of said body panels has a window opening formed therein.

9. The structure claimed in claim 8 wherein said last named body panel has a recessed upper end edge to expose the neck of a bottle or like object packaged in said carton.

10. The structure claimed in claim 1 including an end closure at the opposite end of said tubular body, said last named end closure comprising an end closure flap hingedly connected to the opposite end edge of one of said body panels.

11. The structure claimed in claim 10 wherein said last named end closure flap is configured to correspond to the cross-sectional configuration of the carton body.

12. The structure claimed in claim 11 including a finger tab connected to the outermost side edge of said last named end closure flap.

13. The structure claimed in claim 11 wherein said last named closure flap includes a spaced apart pair of tuck flaps, said end closure flap being recessed in the area between said tuck flaps, whereby to permit the neck of a bottle or like object to project therethrough.

* * * * *